US006451070B1

(12) United States Patent
Kent et al.

(10) Patent No.: US 6,451,070 B1
(45) Date of Patent: Sep. 17, 2002

(54) ULTRAVIOLET STABILITY OF ARAMID AND ARAMID-BLEND FABRICS BY PIGMENT DYEING OR PRINTING

(75) Inventors: George M. Kent, Long Valley, NJ (US); Karen L. Johnson, Charlotte, NC (US); Dean R. Gadoury, Asheville, NC (US); Randy L. Mumford, Charlotte, NC (US)

(73) Assignee: BASF Corporation, Mount Olive, NJ (US)

( * ) Notice: Subject to any disclaimer, the term of this patent is extended or adjusted under 35 U.S.C. 154(b) by 155 days.

(21) Appl. No.: 09/684,882

(22) Filed: Oct. 6, 2000

Related U.S. Application Data

(63) Continuation-in-part of application No. 09/036,529, filed on Mar. 6, 1998, now abandoned.

(51) Int. Cl.[7] ..... D06P 5/02; C09B 67/00

(52) U.S. Cl. ..... 8/442; 8/445; 8/552; 8/925; 8/637.1

(58) Field of Search ..... 8/445, 637.1, 925, 8/552, 442

(56) References Cited

U.S. PATENT DOCUMENTS

| | | | | |
|---|---|---|---|---|
| 3,888,821 A | | 6/1975 | Milford | 260/45.8 |
| 4,077,764 A | | 3/1978 | Von Der Eltz et al. | 8/18 |
| 4,145,371 A | | 3/1979 | Tohyama et al. | 260/856 |
| 4,705,523 A | | 11/1987 | Hussamy | 8/490 |
| 4,705,527 A | | 11/1987 | Hussamy | 8/558 |
| 4,981,488 A | | 1/1991 | Cates et al. | 8/574 |
| 5,074,889 A | | 12/1991 | Hodge et al. | 8/602 |
| 5,076,809 A | | 12/1991 | Bouglas | 8/478 |
| 5,102,424 A | | 4/1992 | Karsunky et al. | 8/490 |
| 5,215,545 A | | 6/1993 | Cates et al. | 8/490 |
| 5,275,627 A | | 1/1994 | Cates et al. | 8/572 |
| 5,556,935 A | * | 9/1996 | Traubel et al. | |
| 5,858,025 A | * | 1/1999 | Batty | |
| 6,007,586 A | * | 12/1999 | Aeschlimann et al. | |

FOREIGN PATENT DOCUMENTS

EP 768423 4/1997

OTHER PUBLICATIONS

Oza et al., "An Aqueous System for Pigment Printing: Reference to Alcoprint P Systems" Textile Dyer and Printer, (Jun. 1, 1988) 21(11) pp. 21–25.*

TT Technical Textiles International, Dec. 1995/Jan. 1996, P. 11.

TT Technical Textiles International,, Mar. 1996, p. 14.

TT Technical Textiles International, Apr. 1997, p. 5.

* cited by examiner

*Primary Examiner*—Margaret Einsmann
(74) *Attorney, Agent, or Firm*—Nixon & Vanderhye P.C.

(57) ABSTRACT

A process for improving the ultraviolet stability of aramid and aramid-blend fabrics by pigment printing or padding the fabrics. The pigment printing process comprises the steps of supplying an aramid textile fabric free of highly polar solvents and dye diffusion promoting agents; pigment printing the fabric by applying onto the fabric a print paste comprising pigment, binder, print paste thickener, and water, the print paste being substantially free of carriers; and drying, then curing the thus-treated fabric at a temperature and for a time sufficient to fix the pigment on the aramid fibers. The padding process comprises the steps of supplying an aramid textile fabric; padding the fabric by soaking in a padding liquor comprising pigment, binder, and water, the padding liquor being substantially free of carriers; and then passing the wet fabric through two rollers to remove excess padding liquor from the fabric; and drying, then curing the thus-treated fabric at a temperature and for a time sufficient to fix the pigment on the aramid fibers.

3 Claims, No Drawings

ULTRAVIOLET STABILITY OF ARAMID AND ARAMID-BLEND FABRICS BY PIGMENT DYEING OR PRINTING

CROSS-REFERENCE TO RELATED APPLICATION

This application is a continuation-in-part of U.S. application Ser. No. 09/036,529 filed on Mar. 6, 1998 (now abandoned).

FIELD OF THE INVENTION

This invention relates to improved ultraviolet stability of aramid and aramid-blend fabrics. More particularly, this invention relates to fabrics containing a blend of melamine resin fibers and aramid fibers which have improved stability when exposed to ultraviolet light and to a method of making such fabrics.

BACKGROUND OF THE INVENTION

Aramid fibers typically exhibit good flame resistance and are characterized by high-temperature durability. Moreover, aramid fibers also typically exhibit high strength, which in turn leads to high tear resistance of fabrics made from such fibers.

Aramid fibers, while possessing many desired properties as manufactured, require various steps to improve a property or properties of the fibers to meet a specific end use. For example, aramid fibers have inherently poor resistance to ultraviolet light. As a result, fabrics made from aramid fibers change color when exposed to ultraviolet light. In addition, there is a significant loss of strength to the fabric as well, thereby causing the fabric to tear more easily.

Because of their good flame resistance and high strength, aramid fibers are used extensively in flame-resistant protective apparel for industrial employees and fire fighters. Because the wearers of these garments are often outdoors, exposure to ultraviolet light leads to color change and to a weakening of the fabric. This is of particular concern to fire fighters because the outer shell fabric of their apparel needs to maintain its strength and not tear open when worn to fight fires. While the National Fire Protection Association (NFPA) sets standards on fabric tear strength, such standards apply only to new fabric. These standards do not apply to fabrics that have already been exposed to ultraviolet light such as, for example, previously worn fire-fighting apparel.

Ultraviolet absorbers or light screeners are often incorporated into the aramid fibers during manufacture or used to treat the aramid fibers in subsequent processing steps to improve their performance and appearance levels. In the normal textile dye process, dye molecules typically penetrate a fiber and become entrapped in the fiber. Alternatively, the dye molecules may chemically bond with the fiber. It is well known in the art, however, that aramid fibers are difficult to dye using conventional techniques. Thus, ultraviolet stabilization of aramid fibers is not easily accomplished by ultraviolet absorbers or light screeners in the dye bath; therefore, the normal dye process does not improve the ultraviolet stability of aramid fibers.

It is known in the art to use carriers, which may also be called "swelling agents" or "dye diffusion promoters," to promote dyeing. For example, U.S. Pat. No. 4,705,527 to Hussamy describes printing of aramid fabrics using a print paste composed of a dye, water, a print paste thickener, and a highly polar solvent fiber swelling agent such as, for example, dimethylsulfoxide (DMSO), dimethylacetamide (DMAC), dimethylformarnide (DMF), or N-methylpyrrolidone (NMP). These print pastes may also contain a flame retardant as described by Hussamy in U.S. Pat. No. 4,705,523. The procedures described by Hussamy, however, require specialized equipment. Moreover, the highly polar solvent fiber swelling agents require about 60% concentration in aqueous solution to maintain their swelling of the aramid fibers, and such high concentrations of organic solvent can damage the aramid fibers.

Similarly, processes for the dyeing or printing of and simultaneously improving the flame-retarding properties of poly(meta-phenyleneisophthalamide) fibers using N-octyl-2-pyrrolidone (NOP) and N-cyclohexyl-2-pyrrolidone (CHP) as dye diffusion promoting agents have been described by Cates et al. in U.S. Pat. Nos. 5,215,545 and 5,275,627, respectively. These processes, however, require the separate application of the dye diffusion promoting agent to the fabric and/or the complete removal of residual dye diffusion promoting agent after dyeing and/or flame retarding.

A need, therefore, exists for a fabric containing aramid fibers or a blend of aramid and other fibers that is substantially free of carriers and that exhibits improved stability when exposed to ultraviolet light and to a simplified method of making the same.

SUMMARY OF THE INVENTION

It is a primary object of the present invention to provide an aramid or aramid-blend fabric having improved stability when exposed to ultraviolet light.

It is also an object of this invention to provide an aramid or aramid-blend fabric which affords longer garment life and better long-term protection.

A further object of the present invention is improved strength retention of aramid or aramid-blend fabric.

Yet a further object of this invention is to provide a method of making an aramid or aramid-blend fabric having improved stability when exposed to ultraviolet light.

Thus, according to the present invention there is provided a process of producing an aramid fabric having improved ultraviolet stability comprising the steps of supplying an aramid textile fabric; pigment printing the fabric by applying onto the fabric a print paste comprising pigment, binder, print paste thickener, and water, the print paste being substantially free of carriers; and drying, then curing the thus-treated fabric at a temperature and for a time sufficient to fix the pigment on the aramid fibers.

In another embodiment, the present invention is a process of producing an aramid fabric having improved ultraviolet stability comprising the steps of supplying an aramid textile fabric; padding the fabric by soaking the fabric in a padding liquor comprising pigment, binder, and water, the padding liquor being substantially free of carriers passing the wet fabric through two rollers to remove excess padding liquor from the fabric; and drying, then curing the thus-treated fabric at a temperature and for a time sufficient to fix the pigment on the aramid fibers.

The above and other objects, effects, features and advantages of the present invention will become more apparent from the following detailed description of the preferred embodiments thereof.

DETAILED DESCRIPTION OF THE PREFERRED EMBODIMENTS

To promote an understanding of the principles of the present invention, descriptions of specific embodiments of the invention follow, and specific language is used to describe the same. It will be understood that no limitation of the scope of the invention is intended by the use of this specific language and that alterations, modifications, equivalents and further applications of the principles of the invention discussed are contemplated as would normally occur to one of ordinary skill in the art to which the invention pertains.

In one embodiment, the present invention is a process of producing an aramid fabric having improved ultraviolet stability comprising the steps of supplying an aramid textile fabric; pigment printing the fabric by applying onto the fabric a print paste comprising pigment, binder, print paste thickener, and water, the print paste being substantially free of carriers; and drying, then curing the thus-treated fabric at a temperature and for a time sufficient to fix the pigment on the aramid fibers.

In a second embodiment, the present invention is a process of producing an aramid fabric having improved ultraviolet stability comprising the steps of supplying an aramid textile fabric; padding the fabric by soaking in a padding liquor comprising pigment, binder, and water, the padding liquor being substantially free of carriers; passing the wet fabric through two rollers to remove excess padding liquor from the fabric; and drying, then curing the thus-treated fabric at a temperature and for a time sufficient to fix the pigment on the aramid fibers.

Fabrics suitable for use in the process of this invention are made from fibers known generally as aromatic polyamides, or aramids. As used herein, the term "aramid" refers to a manufactured fiber in which the fiber-forming substance is generally recognized as a long chain synthetic aromatic polyamide in which at least 85% of the amide linkages (—NH—CO—) are attached directly to two aromatic rings. Suitable aramid fibers include fibers made from poly(para-phenyleneterephthalamide), poly(meta-phenyleneisophthalamide), and copolymers and combinations thereof Preferred aramid fibers for use in the present invention that are commercially available include Kevlar® (E.I. du Pont de Nemours and Company), Twaron® (Akzo Nobel), Technora (Teijin), Nomex® and Nomex Z200 (E.I. du Pont de Nemours and Company), Teijinconex (Teijin), and Apial (Unitika). Fabrics made from poly(para-phenyleneterephthalamide) fibers are most preferred.

Fabrics containing blends of aramid fibers with each other and with other, non-aramid fibers are also suitable for use in the present invention. Non-limiting examples of suitable non-aramid fibers that may be blended with the aramid fibers are melamine resin fibers, flame-resistant cotton, polybenzimidazole fibers, flame-resistant rayon, carbon fibers, polyamide-imide fibers, phenolic fibers, nylon, wool, modacrylic, and combinations thereof The aramid and aramid-blend fabrics useful in the present invention generally contain from about 20% to about 100%, preferably from about 50% to about 70%, of one or more aramid fibers and up to about 80%, preferably from about 30% to about 50%, of other, non-aramid fibers.

A preferred aramid-blend fabric comprises about 60% aramid fibers and about 40% melamine resin fibers. Because melamine resin fibers are notable for their high temperature resistance and nonflammability, they are often used for manufacturing fire resistant textiles. Fibers blends of melamine resin fibers and aramid fibers are known, for example, from U.S. Pat. No. 5,560,990 to Ilg et al., the entirety of which is incorporated herein by reference.

The melamine used can be any melamine resin fibers but is preferably melamine-formaldehyde fibers produced from highly concentrated solutions of melamine-formaldehyde precondensation products, after addition of an acidic curing agent, by rotospinning, drawing out, or extrusion. The ratio of melamine to formaldehyde is preferably within the range of from about 1:1.15 to about 1:4.5 and, more preferably, is about 1:2. Particularly thermally stable fibers are obtained when up to about 30 mole percent, and preferably from about 2 mole percent to about 20 mole percent, of the melamine in the melamine resin is replaced by hydroxyalkylmelamine. One such suitable melamine resin fiber is Basofil® fiber available from BASF Corporation of Mount Olive, N.J.

Textile pigment printing, by definition, involves the printing of an insoluble coloring material (i.e., pigment) on a textile fabric. The pigment, which has no affinity for the fibers of the fabric, is adhered to the fabric by a resin binder. The term "resin-bonded pigment" is often applied to this type of textile printing process and product. In conventional textile pigment printing operations, the pigment colorants and resin binder are in an aqueous emulsion in the form of a thick printing paste, and this printing paste is applied to the fabric by screens. After the paste is printed onto the fabric, the printed fabric is subjected to heat for a period of time at a temperature sufficient to dry and cure the resin binder.

The print paste used in the process of the present invention generally comprises pigment, binder, and print paste thickener, with the balance being water. Other print paste adjuvants such as, for example, antistatic agents, finishing agents, processing aids, and the like may also be present in the print paste. The print paste is substantially free of carriers such as, for example, highly polar solvent fiber swelling agents including but not limited to dimethylsulfoxide (DMSO), dimethylacetamide (DMAC), dimethylformamide (DMF), and N-methylpyrrolidone and dye diffusion promoters including but not limited to N-octyl-2-pyrrolidone (NOP) and N-cyclohexyl-2-pyrrolidone (CHP).

The thickening agent used in the print paste can be any of the conventional thickeners for print pastes suitable for printing textile materials such as, for example, natural starch, British gum, crystal gum, natural and etherified locust bean gums, carboxymethyl cellulose, gum tragacanth, polyacrylic acids, and sodium alginate provided that it is capable of forming a stable, homogenous printing paste of appropriate viscosity to be able to be used in practice. In one embodiment of the invention, the thickening agent will be a polyacrylic acid having a molecular weight range of 450,000 to 4,000,000 and will be present in an amount sufficient so that the resulting print paste will have a viscosity ranging between about 5,000 cps and about 15,000 cps. Preferably, a sufficient amount of thickening agent is from about 1.50% to about 3.00% by weight of the print paste.

Any organic pigment capable of dyeing the aramid fibers may be used. Such pigments may be selected from cationic dyes; solvent dyes; disperse dyes; fiber reactive dyes; vat dyes; azoic dyes; and anionic dyes such as, for example, acid dyes, metalized acid dyes, or direct dyes, provided that the pigment selected is soluble in the print paste and does not affect the homogeneity and stability of the print paste. Combinations of these pigments may also be used in the same print paste provided that they are soluble in the print paste and do not affect the homogeneity and stability of the print paste. The pigment is present in an amount to sufficiently block ultraviolet light and to improve ultraviolet stability of the aramid fibers. Preferably, a sufficient amount of pigment is from about 0.10% to about 15.00%, more preferably from about 2.00% to about 10.00%, by weight of the print paste.

Any resin binder capable of adhering the pigment to the fabric may be used. Such binders can be any of the conventional binders for print pasts useable for printing textile materials such as, for example, acrylic homopolymer and acrylic copolymer binders, latex binders (e.g., styrene-butadiene latex binders), and modified nitrile polymer binders. The binder is present in an amount sufficient to adhere the pigment to the fabric. Preferably, a sufficient amount of binder is from about 3.00% to about 20.00%, more preferably from about 5.00% to about 15.00%, by weight of the print paste.

Printing is conducted at ambient temperatures using conventional printing procedures known in the art, after which the fabric is dried and then heated to fix the pigment to the fabric. Appropriate fixation times and temperatures assure acceptable color retention and endurance properties. Preferably, curing of the printed fabric occurs for a period of about 20 seconds to about 8 minutes and at a temperature of about 280° F. to about 380° F. Even more preferably, the temperature at which the printed fabric is cured is over 300° F. at least for some period of time. Most preferred is a time period of about 3 minutes at a temperature of about 325° F.

Textile padding, by definition, involves the application of an insoluble coloring material (i.e., pigment) on a textile fabric by means of a typical textile wet processing method. In conventional textile padding operations, the pigment colorants and binder are in an aqueous solution in the form of a padding liquor, and this padding liquor is applied to the fabric by soaking the fabric in the liquor and then passing the wet fabric through two rollers to remove excess padding liquor from the fabric. After the liquor is padded onto the fabric, the padded fabric is subjected to heat for a period of time at a temperature sufficient to dry and cure the resin binder.

The padding liquor used in the process of the present invention generally comprises pigment, binder, and water. Other padding liquor adjuvants such as, for example, anti-migrant agents, finishing agents, processing aids, and the like may also be present in the padding liquor. The padding liquor is substantially free of carriers such as, for example, highly polar solvent fiber swelling agents including but not limited to dimethylsulfoxide (DMSO), dimethylacetamide (DMAC), dimethylformamide (DM), and N-methylpyrrolidone and dye diffusion promoters including but not limited to N-octyl-2-pyrrolidone (NOP) and N-cyclohexyl-2-pyrrolidone (CHP).

Any organic pigment capable of dyeing the aramid fibers may be used. Such pigments may be selected from cationic dyes; solvent dyes; disperse dyes; fiber reactive dyes; vat dyes; azoic dyes; and anionic dyes such as, for example, acid dyes, metalized acid dyes, or direct dyes, provided that the pigment selected is soluble in the padding liquor and does not affect the homogeneity and stability of the padding liquor. Combinations of these pigments may also be used in the same padding liquor provided that they are soluble in the padding liquor and do not affect the homogeneity and stability of the padding liquor. The pigment is present in an amount to sufficiently block ultraviolet light and to improve ultraviolet stability of the aramid fibers. Preferably, a sufficient amount of pigment is from about 0.10% to about 30.00%, more preferably from about 5.00% to about 20.00%, by weight of the padding liquor.

Any resin binder capable of adhering the pigment to the fabric may be used. Such binders can be any of the conventional binders for padding liquors useable for padding textile materials such as, for example, acrylic homopolymer and acrylic copolymer binders, latex binders (e.g., styrene-butadiene latex binders), and modified nitrile polymer binders. The binder is present in an amount sufficient to adhere the pigment to the fabric. Preferably, a sufficient amount of binder is from about 1.00% to about 15.00%, more preferably from about 2.00% to about 10.00%, by weight of the padding liquor.

Padding is conducted at ambient temperatures using conventional padding procedures known in the art, after which the fabric is dried and then heated to fix the pigment to the fabric. Appropriate fixation times and temperatures assure acceptable color retention and endurance properties. Preferably, curing of the printed fabric occurs for a period of about 20 seconds to about 8 minutes and at a temperature of about 280° F. to about 380° F. Even more preferably, the temperature at which the padded fabric is cured is over 300° F. at least for some period of time. Most preferred is a time period of about 2 minutes at a temperature of about 325° F.

The invention will be further described by reference to the following detailed examples. The examples are set forth by way of illustration and are not intended to limit the scope of the invention.

As referred to in the examples, the terms and test procedures used are defined as follows:

Off-Loom or "Greige".

Refers to fabric that does not receive any finishing treatment after weaving.

Natural Color.

Refers to fabric that has never been dyed or printed, but has been finished with a water repellent.

Exposure Test.

The test is used to determine the colorfastness to light of the control fabrics and the experimental fabrics and to produce UV-exposed samples for the trapezoid tear test, which is described later. The term "colorfastness to light" refers to the resistance of a material to change in its color characteristics as a result of exposure of the material to sunlight or an artificial light source. The test is performed in accordance with AATCC Test Method 16-1993, Option E (Water-Cooled Xenon-Arc Lamp, Continuous Light).

The test apparatus used in the exposure test includes a water-cooled xenon-arc lamp as the light source, a specimen rack for holding the specimens during exposure, and a black-panel thermometer. Specimens of the experimental textile fabrics and the control fabrics are prepared by cutting swatches of each fabric with the long direction parallel to the machine (warp) direction. Each swatch is of equal size (about 2.75 inches by about 4.7 inches) and shape. The specimens are mounted on white card stock. Portions of each specimen are also covered with white card stock so as to provide exposed areas and unexposed areas, or masked control portions, for each specimen. The specimens are then secured in frames, and the frames are placed in the specimen rack such that the surface of each specimen is the same distance from the light source.

The specimens are all exposed simultaneously to continuous light from a water-cooled xenon-arc lamp for about 100 hours at a temperature of about 145° F.±2° F. and a relative humidity of about 30%±5%. After exposure, the colorfastness to light of each specimen is evaluated by comparing the color change of the exposed portion of each specimen to the masked control portion of each specimen.

The UV-exposed samples for the trapezoid tear test are made in an identical manner, except that each swatch is approximately 3 inches by 6 inches.

Trapezoid Tear Test.

This test comes from the 1997 edition of NFPA 1971, *Standard on Protective Ensemble for Structural Fire Fighting*, and is used to measure the tear strength of the fabrics before and after UV exposure. The apparatus used in the trapezoid tear test consists of a straining mechanism, two clamps for holding the specimens, and load and elongation recording mechanisms, wherein each specimen is held between the clamps and is strained by uniform movement of one of the clamps ("the pulling clamp"). The apparatus is operated at a rate of about 12 inches per minute. The clamps each have two jaws. Each jaw has a flat, smooth gripping surface. The design of the clamps is such that one jaw is part of the rigid frame of the clamp or is fastened to allow a slight vertical movement, while the other jaw is completely moveable. The distance between the jaws at the start of the test is about 1 inch.

Three 3-inch by 6-inch rectangular specimens are cut in the warp direction for each of the control fabrics and the experimental fabrics. An isosceles trapezoid having an altitude of about 3 inches and bases of about 1 inch and about 4 inches in length, respectively, are marked on each specimen. A cut of about 0.375 inch in length is made in the center of a line perpendicular to the 1-inch edge. Each specimen is then conditioned at a temperature of about 70° F.±5° F. and a relative humidity of about 65%±5% until equilibrium is reached, or for at least 24 hours, whichever is shorter. Each specimen is tested within 5 minutes after removal from conditioning.

For the test, each specimen is clamped along the nonparallel sides of the trapezoid so that these sides are positioned along the lower edge of the upper clamp and the upper edge of the lower clamp, with the cut halfway between the clamps. The short trapezoid base is held taut, and the long trapezoid base is positioned in folds. The strain mechanism is started, and the force necessary to tear each specimen is observed by means of a recording device. The tear strength as determined for each individual specimen is determined by averaging the five peaks in the flat portion of the curve. Percent strength retention is determined as follows:

$$\left[\frac{\text{Tear strength before UV exposure} - \text{Tear strength after UV exposure}}{\text{Tear strength before UV exposure}}\right] \times 100$$

EXAMPLES 1–12

Six pieces of a natural color, "off-loom," 40% melamine resin/60% aramid fabric are pigment printed or padded according to the above-described procedures with various pigments at various pigment levels. The test samples, along with six controls, are exposed to ultraviolet light for about 100 hours and then tested for tear strength and final trapezoid tear after exposure according to the above-described test procedures. The results are summarized in Table I below.

TABLE I

| Sample | Original Trapezoid Tear (lbs) (warp direction) | Final Trapezoid Tear (lbs) (warp direction) | Strength Retention (%) |
|---|---|---|---|
| Black Aramid Z200 (control 1) | 25.1 | 13.8 | 55.0 |
| Natural PBI/Kevlar ® (control 2) | 38.3 | 13.9 | 36.3 |
| Black Nomex ® III (control 3) | 53.5 | 9.5 | 17.7 |
| Natural Basofil ®/ Kevlar ® (control 4) | 39.0 | 10.1 | 25.9 |
| Granite Basofil ®/ Kevlar ® (control 5)[1] | 35.6 | 12.7 | 35.7 |
| Basofil ®/Kevlar ® Off-Loom (control 6) | 37.2 | 10.9 | 29.3 |
| 20% Black Print | 20.9 | 20.7 | 99.0 |
| 10% Gold/Yellow Pad | 28.5 | 19.2 | 67.4 |
| 20% Charcoal Pad | 22.6 | 14.8 | 65.5 |
| 9.15% Tan Pad | 34.6 | 18.3 | 52.9 |
| 20% Yellow Pad | 35.1 | 17.8 | 50.7 |
| 10% Yellow Pad | 28.3 | 15.3 | 54.1 |

[1]A 40/60 blend of Basofil ® and solution-dyed (by producer) black Kevlar ® which gives the fabric a heather gray or "granite" color.

Table I indicates that pigment printing and padding can reduce the tear strength of the aramid fabrics from about 37 pounds prior to pigment printing or padding to between about 21 and about 35 pounds afterwards, depending on pigment type and level. The NFPA requirement is 22 pounds in both the warp and the filling directions. Thus, in order for a pigment printed or padded fabric to be useful in NFPA certified garments, the pigment printing or padding process should be adjusted so as to maintain a trapezoid tear greater than 22 pounds after pigment printing or padding. Alternatively, the fabric weight or construction could be adjusted so as to maintain the tear strength above 22 pounds after pigment printing or padding the fabric. Table I also shows that pigment printing and padding significantly improve tear strength retention (UV resistance) after UV exposure. It is also noted that the color retention of the samples is good and that flammability is not significantly affected.

While the invention has been described in connection with what is presently considered to be the most practical and preferred embodiment, it is to be understood that the invention is not to be limited to the disclosed embodiment, but on the contrary, is intended to cover various modifications and equivalents arrangements included within the spirit and scope of the appended claims.

What is claimed is:

1. A process of printing and improving the ultraviolet stability of an aramid textile fabric consisting essentially of about 100% aramid fibers, the process comprising the steps of:

(a) applying onto the surface of the fabric a print paste comprising pigment, binder, print paste thickener, and water, wherein the binder is selected from the group consisting of acrylic homopolymer binders, styrene-butadiene latex binders, and modified nitrile polymer binders, the print paste being substantially free of carriers; and (b) drying, then curing the thus treated fabric at a temperature and for a time sufficient to fix the pigment on the aramid fibers.

2. The process of claim 1, wherein the aramid fibers are selected from the group consisting of poly(para-phenyleneterephthalamide) fibers, poly(meta-phenyleneisophthalamide) fibers, and copolymers and combinations thereof.

3. The process of claim 1, wherein the thus-treated fabric is cured at a temperature of from about 280° F. to about 380° F.

* * * * *